US005388842A

United States Patent [19]

Piras et al.

[11] Patent Number: 5,388,842

[45] Date of Patent: Feb. 14, 1995

[54] DEVICE FOR HOLDING THE TOOL OF A HYDRAULIC ROCK BREAKER

[75] Inventors: Bernard Piras, Charly; Jean S. Comarmond, Vourles, both of France

[73] Assignee: Etablissements Montabert, Saint Priest, France

[21] Appl. No.: 77,883

[22] Filed: Jun. 15, 1993

[30] Foreign Application Priority Data

Jun. 16, 1992 [FR] France ..... 92 07542

[51] Int. Cl.[6] ..... B25D 17/00

[52] U.S. Cl. ..... 279/19.5; 279/97

[58] Field of Search ..... 279/19, 19.3, 19.5, 279/76, 85, 97

[56] References Cited

U.S. PATENT DOCUMENTS 1,969,798 8/1934 Hultquist ..... 279/97

2,716,393 8/1955 Fischer ..... 279/19.3 X

FOREIGN PATENT DOCUMENTS 2353679 6/1974 Germany ..... 279/97

2809569 9/1979 Germany ..... 279/19

*Primary Examiner*—Steven C. Bishop

*Attorney, Agent, or Firm*—Herbert Dubno

[57] ABSTRACT

This device is of the type in which the tool is mounted so as to slide, with interposition of upper and lower guide means, in a front guide. According to the invention, at least one of the guide means delimits a guide zone, the directrix of which comprises points of inflection forming separation angles between facets, which zone cooperates with a zone of complementary cross-section made, at least locally, on the tool in order to rotationally lock this tool.

8 Claims, 3 Drawing Sheets

FIG 1
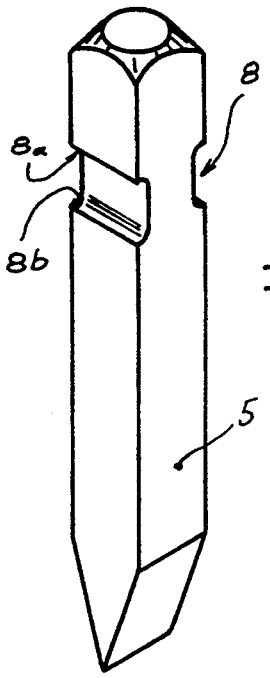
FIG. 2
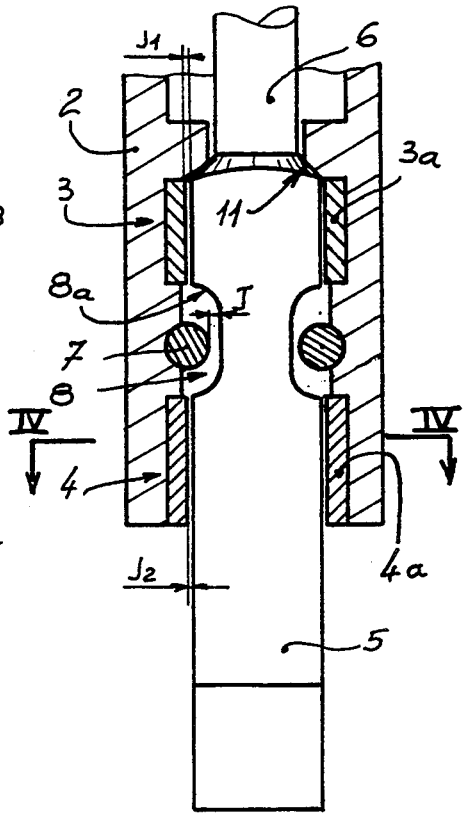
FIG. 3
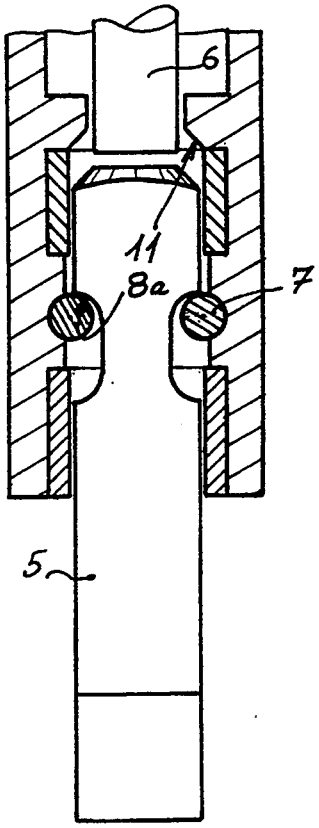
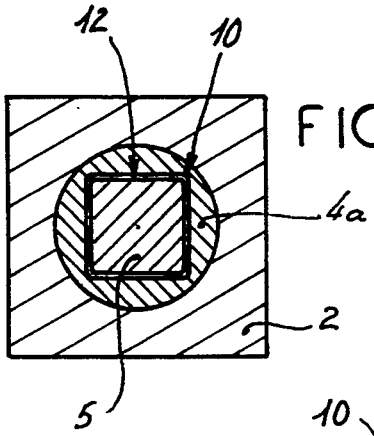
FIG.4
FIG.5
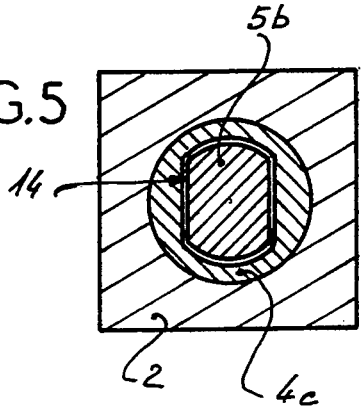
FIG.6
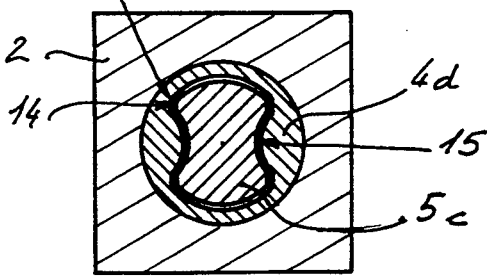

DEVICE FOR HOLDING THE TOOL OF A HYDRAULIC ROCK BREAKER

FIELD OF THE INVENTION

The invention relates to a device for holding a tool of a hydraulic rock breaker.

Percussion-type apparatus driven by a pressurized fluid, commonly called a rock breaker, is a highpower apparatus which can be installed on supporting machines. They comprise a body, generally composed of a plurality of parts joined together by screws or bolts. These parts may be grouped together according to two functions:

- the upper part or parts of the rock breaker support the entire percussion mechanism and, in particular, the percussion piston,
- the lower part or parts support, in particular, the tool intended to transmit shock to the rock. These lower parts of the body are generally called front guides.

In order for the rock breaker to operate correctly, the front guide has to provide, in relation to the tool, a certain number of functions:

- guiding, that is to say maintaining coaxiality between the percussion piston and the tool, and withstanding the flexural forces induced by the supporting machine. This function is generally provided by a top guide support and a bottom guide support,
- stopping rotation, by means of removable components, generally called keys, which withstand the resisting torque generated by the tool being driven into the ground, and
- axial retention of the tool, when the latter tries to escape from the front guide, this function also being provided by the keys located between the top guide support and the bottom support.

The known solutions for providing these functions all have common characteristics. The guiding of the tool is effected on cylindrical supports, either of the same diameters or of different diameters. The stopping of rotation and the axial retention of the tool are effected by one or more removable keys which are cylindrical or have flats.

Given the magnitude of the stresses exerted by the supporting machine on the rock breaker, the contact pressures generated between the tool and its guide supports are very high. Moreover lubrication of this guide can only be provided in a very random fashion.

These mounting and operating conditions lead to jamming, rapid deterioration of the cylindrical surfaces in contact, to the rapid decrease in the quality of the guiding and to the damage of the keys and key supports.

These drawbacks are inherent, on the one hand, in the surfaces actually in contact, between the tool and its cylindrical guide, being too small and, on the other hand, in the dual function of the keys. In fact, it is mechanically difficult to produce large-sized removable keys which can both provide the axial retention of the tool and stop it from rotating, with over wide, and therefore little stressed, surfaces.

SUMMARY OF THE INVENTION

The present invention provides a holding device overcoming these drawbacks.

For this purpose, in the device according to the invention, at least one of the translational guide means delimits a rotational-locking zone cooperating with a zone of complementary cross-section made, at least locally, on the tool.

By virtue of this arrangement, the guiding of the tool and its rotational locking are provided by the same components, whereas the key or keys provide only the axial retention of the tool. These keys are therefore not responsible for the rotational locking of the tool which is provided exclusively by the two guide zones made in one of the guide means and on the tool, zones which can have surfaces which are of much greater area and are more capable of resisting the torsional and flexural stresses.

Advantageously, the directrix of the translational-guiding and rotational-locking zone comprises points of inflection forming separation angles between facets.

In one embodiment of the invention, the guide zone is delimited by the bore of a guide bush and includes at least two pairs of opposed active facets.

In another embodiment, the guide zone is delimited by at least two opposed pairs of independent small plates attached in the bore of the guide body and each including an active facet.

BRIEF DESCRIPTION OF THE DRAWING

Other characteristics and advantages will emerge from the description which follows with reference to the attached diagrammatic drawing, illustrating several embodiments of this guide and rotational-locking device for a concrete-breaking tool. In the drawing:

FIG. 1 is a perspective view of an embodiment of a tool;

FIGS. 2 and 3 are side views in longitudinal section showing the tool of FIG. 1, respectively when it is in the working position and when it is in the limit-stop position on the keys when the apparatus is raised;

FIG. 4 is a view in transverse section along IV—IV of FIG. 2 showing the means for guiding the tool of FIG. 1;

FIGS. 5 and 6 are views similar to FIG. 4, but showing two other embodiments of the bush-shaped guide means and of the tool;

SPECIFIC DESCRIPTION

Figure 7:
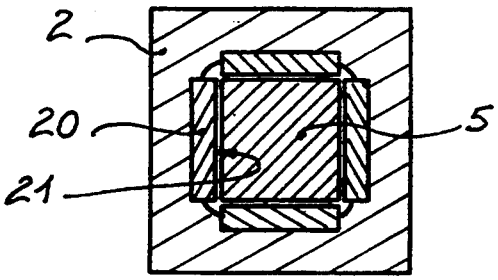
FIGS. 7 to 12 are views in transverse section, similar to FIG. 2, showing other embodiments of the tool and of the guide means and, more especially, of the guide means using small plates.
Figure 8:
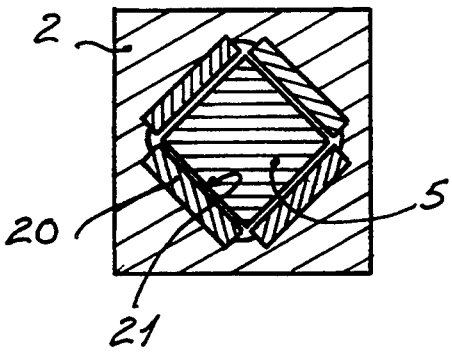
Figure 9:
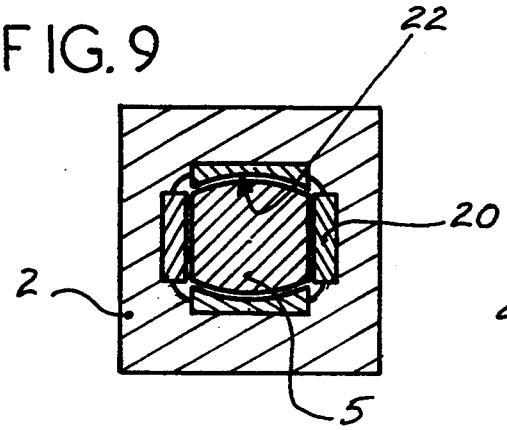
Figure 11:
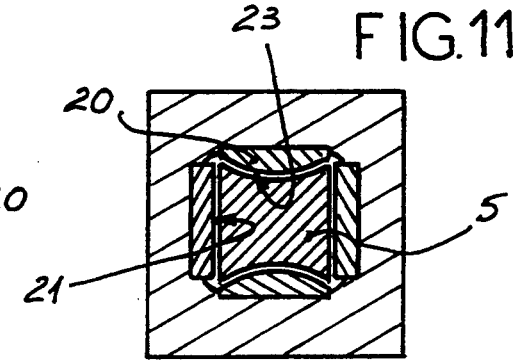
Figure 10:
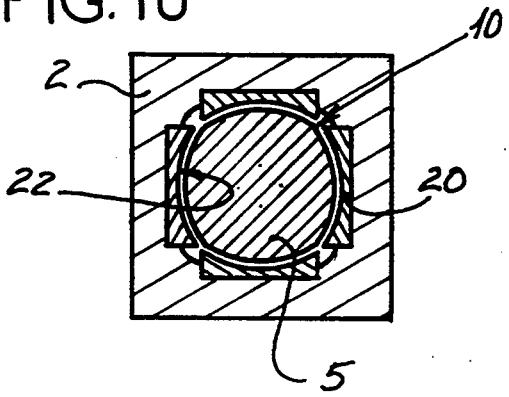
Figure 12:
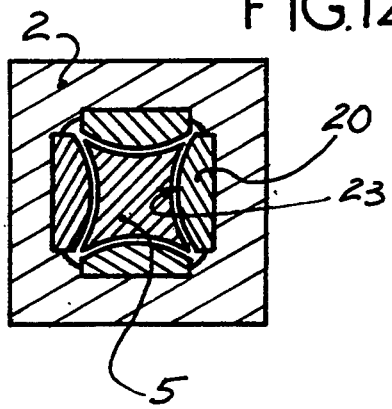

In FIGS. 2 and 3, the reference 2 designates the front guide which includes, in a known manner, upper guide means 3 and lower guide means 4 for a tool 5 arranged coaxially with a percussion piston 6. The tool 5 is retained longitudinally in the front guide 2 by two transverse keys 7 passing across this front guide and each cooperating with a limit-stop face 8a forming part of two transverse notches 8 made in the tool 5.

According to the invention, in the embodiment represented in FIGS. 1 to 6, the rotational locking of the tool 5 in relation to the front guide 2 is provided by two guide means 3 and 4 which each include a guide zone, the directrix of which includes points of inflection forming separation angles 10 between facets 12, that is to say it has non-circular, polygonal or pseudopolygonal shapes.

In the embodiment of FIGS. 1 to 4, the tool 5 has a square transverse cross-section and cooperates with upper and lower bushes 3*a* and 4*a*, constituting the guide means, also having an axial bores of square cross-section.

In the embodiment represented in FIG. 5, the tool 5*b* includes two flats 14 constituting the facets 12 and cooperates with a bush 4*c* of similar internal cross-section.

In FIG. 6, the tool 5*c* is equipped, in its flats 14, with two concave facets 15. This tool cooperates with a bore of the same cross-section as that made in a bush 4*d* supported by the front guide 2.

When the rock breaker bears on the rock, the upper end of the tool comes to bear on a limit-stop face 11 made in the front guide 2 in order to limit its engagement. The flexural stress communicated to the tool is compensated for by the reaction forces which are exerted on the facets 12 of the guide means 3*a*–3*b*.

FIG. 2 shows that the transverse clearances J1–J2 provided between the tool 5 and its guide means 3 and 4, irrespective of their embodiments, are less than the clearance J made between the keys 7 and the bottom of the notches 8, so that, in any case, the tool cannot come into contact with the keys in its transverse movements.

When the tool is deeply engaged into the soil and when a resisting torque is applied to the entire front part of the apparatus, the tool is rotationally locked by its wide active facets coming into contact with the facing facets of the guide means 3 and 4. The clearance J is also determined so that the keys 7 cannot come into contact with the tool under its working conditions.

FIG. 3 shows that, when the tool is no longer bearing (i.e. falls down relative to the guide 2), the retaining keys 7 come into contact with the limit-stop faces 8*a* of the notches 8 and thus retain the tool in the front guide of the rock breaker.

The embodiments represented in FIGS. 7 to 12 differ from the previous ones by the fact that each of the guide means is not constituted by a bush but by at least two pairs of opposed small plates 20 attached in the front guide 2. These small plates may be distributed on the four sides of a square or a rectangle and may include plane active faces, as shown at 21 in FIGS. 7 and 8, concave active faces, as shown at 22 in FIGS. 9 and 10, or convex faces, as shown at 23 in FIGS. 11 and 12. Their back face may be plane or convex depending on the shape of the face against which they bear.

In all these embodiments, the small plates delimit a guide zone, the directrix of which includes points of inflection delimiting ridges 10 and plane or curvilinear facets. Of course, the transverse cross-section of the tool 5 is complementary to that of the guide zone, as already described in the previous embodiments.

Figure 13:
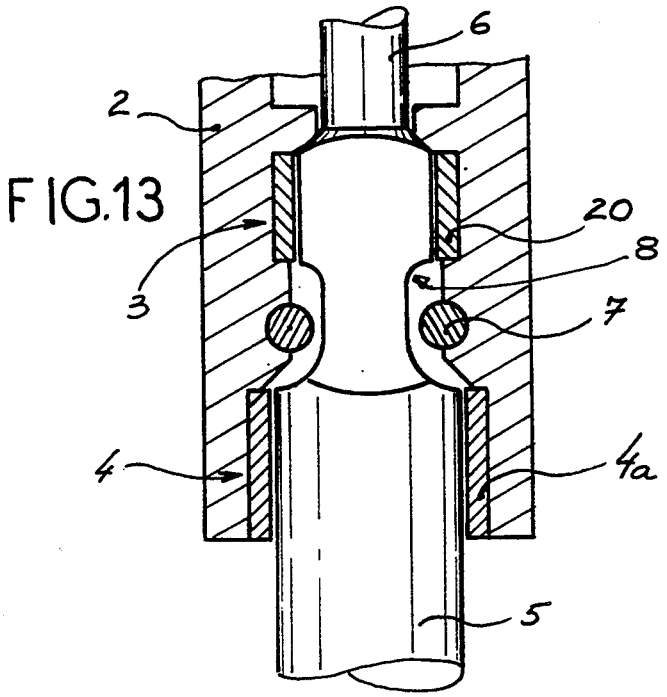
FIG. 13 is a partial view in longitudinal section showing another embodiment of the means for guiding the tool.

In the embodiment represented in FIG. 13, only the upper guide means 3 are composed of small plates 20 delimiting a guide zone of square cross-section, cooperating with a square zone of the tool, whereas the lower guide means 4 are constituted by a bush 4*a* which includes a cylindrical bore. According to this embodiment, the tool 5 has, at the top part, a square polygonal cross-section and, beneath the notches 8, a cylindrical cross-section.

The stresses due to the resisting torque are therefore taken up by the small plates 20, whereas the guiding of the bottom part of the tool is provided by the bush 4 and the axial retention is provided by the keys 7.

The same results may be obtained in an alternative embodiment of FIG. 13, in which alternative the rotational locking of the tool is not provided by the upper guide means 3, but by the lower means 4.

Figure 14:
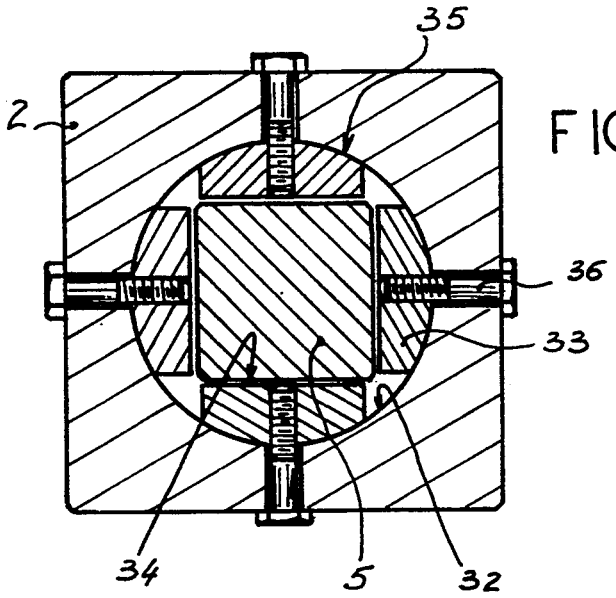
FIGS. 14 and 15 are views in transverse section showing, on an enlarged scale, the application of the guide means according to the invention to existing front guides which include a cylindrical bore.
Figure 15:
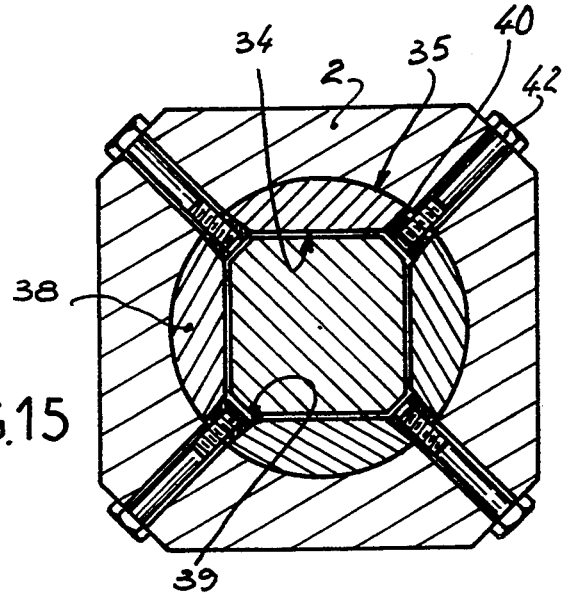

FIGS. 14 and 15 show the application of the guide device according to the invention with a front guide 2 which has a longitudinal bore 32 of circular cross-section.

In FIG. 14, each of the small plates 33 includes a plane active face 34 cooperating with a complementary face of the tool 5 and a semicylindrical back face 36 bearing against the wall of the bore 32. The small plates are fixed by radial screws 36.

In the embodiment represented in FIG. 15, the small plates 38, of the same type as those 33 previously mentioned, that is to say including a plane active face 34 and a semicylindrical back face 35, are equipped on their longitudinal edges with sloping faces 39 intended to cooperate with corners 40 which are inserted between two successive small plates. These corners are fixed by screws 42 pulling them radially outwards. The small plates 38 are thus clamped by their sides on the inside of the cylindrical bore 32 of the front guide.

It is obvious that the guide device with rotational locking according to the invention may have any cross-section other than those described up to now, as long as the combination of the facets of the tool with those of the one or more complementary guide means make it possible to take up the resisting torque on the wide support surfaces.

We claim:

1. A device for holding a tool of a hydraulic rock breaker wherein the tool is arranged coaxially with a percussion piston, said tool being mounted so as to slide, with interposition of upper and lower translational guide means, in a front guide, and being limited in its travel, respectively, upwards, by a limit-stop face of the guide and, downwards, by at least one transverse key arranged between the guide means and also forming a means for axially retaining said tool in the guide, said upper translational guide means delimiting a rotational-locking zone cooperating with a zone of complementary cross-section made, at least locally, on the tool, a directrix of the translational-guide and rotational-locking zone comprising points of inflection forming separation angles between facets, the lower translational guide means including a bush of cylindrical inner cross section surrounding a cylindrical portion of said tool, said key being free from any translational guidance of said tool.

2. The device defined in claim 1 wherein the translational-guide and rotational-locking zone is delimited by the bore of a guide bush and includes, at least, two pairs of active and opposed facets.

3. A device for holding a tool of a hydraulic rock breaker wherein the tool is arranged coaxially with a percussion piston, said tool being mounted so as to slide, with interposition of upper and lower translational guide means, in a front guide, and being limited in its travel, respectively, upwards, by a limit-stop face of the guide and, downwards, by at least one transverse key arranged between the guide means and also forming a means for axially retaining said tool in the guide, at least one of the translational guide means delimiting a rotational-locking zone cooperating with a zone of complementary cross-section made, at least locally, one the tool, the translational-guide means delimiting said rotational-locking zone is formed by at least two pairs of independent opposed small plates attached in the bore of the guide body and each including an active facet.

4. The device defined in claim 3 wherein the active facet of at least two opposed small plates is plane.

5. The device defined in claim 3 wherein the active facet of at least two opposed small plates is convex.

6. The device defined in claim 3 wherein the active facet of at least two opposed small plates is concave.

7. The device defined in claim 3 wherein each small plate includes a plane back bearing against a plane part of the bore receiving this small plate.

8. The device defined in claim 3 wherein each small plate includes a convex back bearing against the cylindrical wall of the bore of the front guide.

* * * * *